US005751583A

United States Patent [19]

Kyuno et al.

[11] Patent Number: 5,751,583

[45] Date of Patent: *May 12, 1998

[54] EMBROIDERY DATA PROCESSING METHOD

[75] Inventors: Mitsuyasu Kyuno, Aichi-ken; Masahiro Mizuno, Nagoya; Masao Futamura, Nagoya; Yukiyoshi Muto, Nagoya, all of Japan

[73] Assignee: Brother Kogyo Kabushiki Kaisha, Nagoya, Japan

[ * ] Notice: The term of this patent shall not extend beyond the expiration date of Pat. No. 5,499,589.

[21] Appl. No.: 391,168

[22] Filed: Feb. 21, 1995

[30] Foreign Application Priority Data

Feb. 25, 1994 [JP] Japan ..... 6-027733

[51] Int. Cl.[6] ..... G06F 19/00

[52] U.S. Cl. ..... 364/470.08; 364/470.09; 112/102.5

[58] Field of Search ..... 364/470, 470.07, 364/470.08, 470.01, 470.09, 470.02; 112/103, 121.11, 121.12, 121.13, 266.1, 453, 457, 102.5, 470.04, 475.19

[56] References Cited

U.S. PATENT DOCUMENTS 5,335,182 8/1994 Asano ..... 364/470
5,386,789 2/1995 Futamura et al. ..... 364/470
5,474,000 12/1995 Mizuno et al. ..... 364/470
5,499,589 3/1996 Kyuno et al. ..... 112/102.5

FOREIGN PATENT DOCUMENTS 4-174699 6/1992 Japan .

*Primary Examiner*—Reba I. Elmore
*Assistant Examiner*—Thomas E. Brown
*Attorney, Agent, or Firm*—Oliff & Berridge

[57] ABSTRACT

An apparatus for processing embroidery data to control a sewing machine to form an embroidery on a work sheet, the apparatus including an image reader which reads, from an original having an original image including one or more outline-bounded regions each having one or more outlines and an inside area bounded by the outline(s), the original image so as to produce image data defining one or both of the outline(s) and the inside area of the outline-bounded region; a first device which produces, based on the image data, outline sewing data to form stitches along the outline of the outline-bounded region; and a second device which produces, based on the image data, area sewing data to form stitches filling the inside area of the outline-bounded region, the embroidery data including the outline sewing data and the area sewing data.

24 Claims, 11 Drawing Sheets

EMBROIDERY DATA PROCESSING METHOD

BACKGROUND OF THE INVENTION

1. Field of the Invention

The present invention relates to a method and an apparatus for processing embroidery data to control a sewing machine to form, on a work sheet, an embroidery corresponding to an original image comprising one or more outline-bounded regions.

2. Related Art Statement

In the field of industrial embroidery sewing machines, there is known an embroidery-data processing apparatus including a microcomputer capable of processing highly accurate embroidery data in a short time. The processing apparatus is provided by a wide-use personal computer which additionally includes an image scanner and a hard-disk drive. The prior apparatus produces, from an original image, embroidery data to form a multiple-color embroidery corresponding to the original image.

Recently, in the field of domestic or home-use embroidery sewing machines, there has been a demand for an embroidery-data processing apparatus which processes embroidery data to form an embroidery corresponding to user's desirable original image and which costs low and is easy to use. This demand results from various reasons such as the diversification and/or sophistication of favorites of users, or the improvements of performance of embroidery sewing machines. That is, the users are not satisfied with the conventional sewing machines that can only form an embroidery according to embroidery data pre-stored in the machines. In particular, there is a strong demand for a home-use apparatus which processes embroidery data to form a multiple-color embroidery with a plurality of embroidery threads having different colors, respectively.

In the background, non-examined Japanese patent application (JP) laid open under publication No. 4(1992)-174699 discloses an embroidery-data processing apparatus to meet the above-mentioned demand. This apparatus includes (a) a main device having an incorporated microcomputer, a small-sized display, and several operable keys, and (b) an achromatic-image scanner which produces binary bit-map data representing the white or black color of each picture element of an achromatic original image. When the prior apparatus is operated to process embroidery data to form a multiple-color embroidery with color-different threads, the image scanner is used to pick up or read an achromatic original image and produce image data (i.e., binary bit-map data) defining the original image, as follows:

In the case of embroidering, for example, an original "plant" image, A, shown in FIG. 5, the original image A includes five outline-bounded regions, A1, A2, A3, A4, and A5. The region A1 is the center of the flower of the plant; the region A2 is the petal of the flower; the region A3 is the stem of the plant; and the two regions A4 and A5 are the left-hand and right-hand leaves of the plant, respectively. Each of the outline-bounded regions A1 to A5 has one or more outlines and an inside area bounded by the outline(s). Here, it is assumed that a user has his or her intention that different regions indicated at different hatchings in FIG. 5 are embroidered with different threads having different colors, respectively. Specifically described, since the two regions A4 and A5 are indicated at a common hatching, those regions are sewn using a common thread, i.e., in a common color. Each of the remaining regions A1, A2, A3 is illustrated at a hatching different from those for the other regions, and is sewn with a thread having a color different from the other colors. After all, four sorts of threads, i.e., four colors in total are used to produce a multiple-color embroidery corresponding to the achromatic original image A. To this end, the user is required to prepare four part-original sheets, B1, B2, B3, and B4, as shown in FIGS. 11(A), 11(B), 11(C), and 11(D), which have four part-original images, A1; A2; A3; A4, A5, to be embroidered in the first to fourth colors, respectively. The achromatic image scanner is operated to stepwise read each of the four part-original sheets B1 to B4. Each of the part-original sheets B1 to B4 is prepared by drawing, using, e.g., a black-ink pen, a corresponding part-original image A1, A2, A3, and A4, A5 on a white sheet. Each time the image scanner reads each part-original image A1, A2, A3, and A4, A5 from a corresponding part-original sheet B1, B2, B3, and B4, the microcomputer processes a batch of embroidery data to form stitches filling the inside area(s) of the region(s) of each part-original image. In this case, four batches of embroidery data are processed.

More specifically described, first, the user makes a copy of the outline of the region A1, onto an initial white sheet B1, by using an original B having the original image A shown in FIG. 5 and, e.g., a red carbon paper (red color is not readable or detectable by the achromatic image scanner). Then, the inside area of the outline of the region A1 copied on the sheet B1 is colored in with a black-ink pen (black color is readable by the achromatic image scanner). Thus, the first part-original sheet B1 shown in FIG. 11(A) is prepared. In FIG. 11(A) and each of FIGS. 11(B) to 11(D), the colored-in region(s) is/are indicated at a hatching as a matter of convenience. The same steps are made for each of the regions A2 and A3, so that the second and third part-original sheets B2 and B3 shown in FIGS. 11(B) and 11(C) are prepared. Finally, the two regions A4 and A5 to be embroidered in a common color are copied and colored in on the single sheet B4, so that the fourth part-original sheet B4 shown in FIG. 11(D) is obtained.

Generally, the inside area of an outline-bounded region is embroidered by being filled with stitches such as satin stitches, seed stitches, or multiple-pattern stitches. The multiple-pattern sewing is carried out by forming a multiplicity of prescribed patterns (e.g., circles, stars, etc.) in the inside area of an outline-bounded region and thereby filling the region with the thus formed multiple-pattern stitches. Meanwhile, in the case of embroidering, on a work sheet, a particular sort of original image such as an animation character, the embroidery formed on the work sheet can enjoy a better appearance when stitches are formed along the outline(s) of the original image in zigzag-stitch sewing, triple-, double-, or single-stitch sewing, or E-stitch sewing, in addition to the sewing of the inside area of the original image in satin-stitch sewing, seed-stitch sewing, or multiple-pattern sewing. The E-stitch sewing is carried out by forming main stitches along the straight or curved outline(s) while forming lateral stitches perpendicular to the main stitches. Owing to the trimming provided by the stitches formed along the outline(s), the embroidery shows up in the background of the work sheet.

However, the processing apparatus disclosed in JP 4-174699 cannot produce, only with the four part-original sheets B1 to B4, outline sewing data to form stitches along the outlines of the regions A1 to A5. If a user desires to form stitches around the outline(s) of an outline-bounded region in addition to forming stitches to fill the inside area of the same, the user is required to prepare a separate part-original sheet on which a peripheral area or areas is/are defined in the neighborhood of the outline(s) of the region. The separate part-original sheet or image is read by the image scanner. In the latter case, the peripheral area(s) defined around the outline(s) is/are handled as an outline-bounded region or regions, and accordingly the additional part-original sheet is needed. However, the embroidery data to embroider the peripheral area(s) defined around the outline(s) are just area sewing data to form stitches filling the peripheral area(s), but not outline sewing data to form stitches along the outline(s). In addition, the amount of working of the user to produce the embroidery data necessary to form the trimmed embroidery is much increased.

In the prior embroidery-data processing apparatus for the home-use embroidery sewing machines, the achromatic image scanner is employed for economic and other reasons. Therefore, for producing embroidery data to form a multiple-color embroidery, a user is required to prepare the same number of part-original sheets as the number of colors used. Accordingly, even though the user may choose not to embroider any peripheral area around the outlines, the amount of working of the user is very large.

SUMMARY OF THE INVENTION

It is therefore an object of the present invention to provide a method and an apparatus for easily producing embroidery data to form an embroidery corresponding to an original image, the embroidery data including outline sewing data to form stitches along the outline(s) of the original image.

The above object has been achieved by the present invention. According to a first aspect of the present invention, there is provided an apparatus for processing embroidery data to control a sewing machine to form an embroidery on a work sheet, the apparatus comprising: an image reader which reads, from an original having an original image comprising at least one outline-bounded region having at least one outline and an inside area bounded by the outline, the original image so as to produce image data defining at least one of the outline and the inside area of the outline-bounded region; a first device which produces, based on the image data, outline sewing data to form stitches along the outline of the outline-bounded region; and a second device which produces, based on the image data, area sewing data to form stitches filling the inside area of the outline-bounded region, the embroidery data including the outline sewing data and the area sewing data.

In the embroidery-data processing apparatus constructed as described above, the first device produces, based on the image data, outline sewing data to form stitches along the outline of the outline-bounded region of the original image, and the second device produces, based on the image data, area sewing data to form stitches filling the inside area of the outline-bounded region. Thus, the present apparatus easily produces, based on the image data, embroidery data including both the outline sewing data and the area sewing data.

In a preferred embodiment according the first aspect of the invention, at least one of the first and second devices comprises a first sewing-manner-specifying device which specifies a first sewing manner. The first sewing manner may be one and only sewing manner pre-stored in a memory such as a read only memory (ROM) of a microcomputer, or a sewing manner selected automatically or by a user from a plurality of sewing manners pre-stored in a memory.

In another embodiment according the first aspect of the invention, at least one of the first and second devices further comprises first producing means for producing at least one of the outline sewing data and the area sewing data to form stitches in the first sewing manner.

In yet another embodiment according the first aspect of the invention, at least one of the first and second devices further comprises an input device which is operable for selecting a mode in which the first producing means does not produce at least one of the outline sewing data and the area sewing data. In this case, the apparatus can prevent producing unnecessary outline or area sewing data.

In another embodiment according the first aspect of the invention, at least one of the first and second devices further comprises: a second sewing-manner-specifying device which specifies a second sewing manner different from the first sewing manner; and second producing means for producing at least one of the outline sewing data and the area sewing data to form stitches in the second sewing manner. The second sewing-manner-specifying device may be operated for specifying the second sewing manner, before or after the first producing means produces the outline sewing data and/or the area sewing data. In the latter case where the second sewing-manner-specifying device specifies the second sewing manner after the first producing means produces the outline sewing data and/or the area sewing data, the outline sewing data and/or the area sewing data produced by the first producing means are replaced by the outline sewing data and/or the area sewing data produced by the first producing means. In this case, the apparatus can produce various sorts of embroidery data corresponding to a single original image.

In another embodiment according the first aspect of the invention, the first sewing-manner-specifying device comprises means for selecting, as the first sewing manner, one of a plurality of sewing manners, based on a characteristic of the outline-bounded region. The characteristic of the region may be a magnitude such as an area, a maximum length, or a length of the outline thereof. Otherwise, the characteristic may be a degree of complexity of shape of the outline thereof. In this case, the apparatus can produce various sorts of embroidery data corresponding to a single original image. In addition, the thus selected sewing manner is suitable for the characteristic of the region.

In another embodiment according the first aspect of the invention, the first sewing-manner-specifying device comprises an input device which is operable for selecting, as the first sewing manner, one of a plurality of sewing manners. In this case, the apparatus can produce various sorts of embroidery data corresponding to a single original image.

In another embodiment according the first aspect of the invention, the image reader comprises means for producing the image data comprising at least one of (a) outline-defining data defining the outline of the outline-bounded region and (b) area-defining data defining the inside area of the outline-bounded region. The outline-defining data defining the outline of the region may be used as data defining the inside area of the region, and the area-defining data defining the inside area of the region may be used as data defining the outline of the region.

According to a second aspect of the present invention, there is provided a method of processing embroidery data to control a sewing machine to form an embroidery on a work sheet, the method comprising the steps of: (a) reading, from an original having an original image comprising at least one outline-bounded region having at least one outline and an inside area bounded by the outline, the original image so as to produce image data defining at least one of the outline and the inside area of the outline-bounded region, (b) producing, based on the image data, outline sewing data to form stitches along the outline of the outline-bounded region, and (c)

producing, based on the image data, area sewing data to form stitches filling the inside area of the outline-bounded region, the embroidery data including the outline sewing data and the area sewing data.

The embroidery-data processing method arranged as described above enjoys the same advantages as those of the embroidery-data processing apparatus in accordance with the first aspect of the present invention.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

First, by reference to FIGS. 1 to 5 and 6(A) to 6(E), there will be described an embroidery-data processing apparatus 1 to which the present invention is applied. The present apparatus 1 produces or processes embroidery data to control a domestic or home embroidery sewing machine 15 (FIG. 10) to form an embroidery on a work sheet such as a fabric, cloth, or leather. The following description relates to the operation of the apparatus 1 for processing embroidery data to form a color embroidery corresponding to an original "plant" image, A, shown in FIG. 5. The original image A is drawn, using a black-ink pen, on a white sheet, B, to be used as an original.

Figure 5:
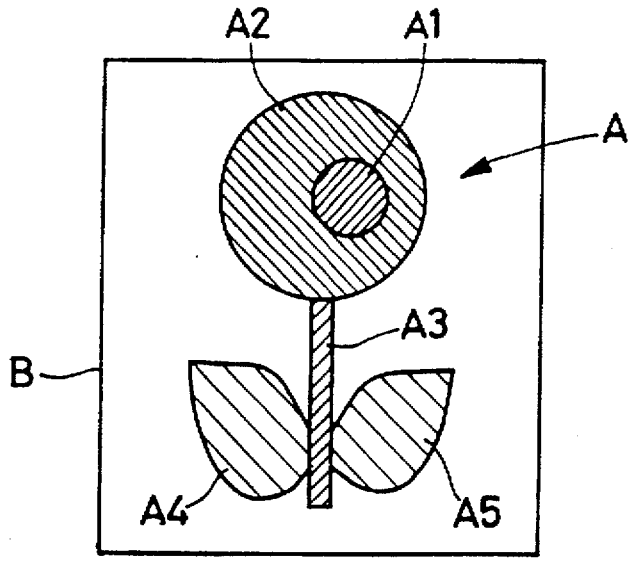
FIG. 5 is a view of an original image, A, which is picked up by an image scanner of the apparatus of FIG. 1 to produce image data defining the original image A.

As shown in FIG. 5, the original "plant" image A includes five outline-bounded regions, A1, A2, A3, A4, and A5. The region A1 is the center of the flower of the plant; the region A2 is the petal of the flower; the region A3 is the stem of the plant; and the regions A4, A5 are the left-hand and right-hand leaves of the plant, respectively. Each of the outline-bounded regions A1 to A5 has one or more outlines and an inside area bounded by the outline(s). For example, the region A1 is bounded by a single outline, whereas the region A2 is bounded by two outlines an inner one of which is also the outline of the region A1. In the following description, it is assumed that different regions indicated at different hatchings in FIG. 5 are embroidered with different needle threads having different colors, respectively. Since the regions A4 and A5 are indicated at a common hatching, those regions are embroidered using a common thread, i.e., in a common color. Since each of the regions A1, A2, A3 is illustrated at a hatching different from those for the other regions and accordingly is embroidered using a needle thread having a color different from the other colors, four sorts of needle threads, i.e., four colors in total are used to produce a multiple-color embroidery corresponding to the original image A.

Figure 1:
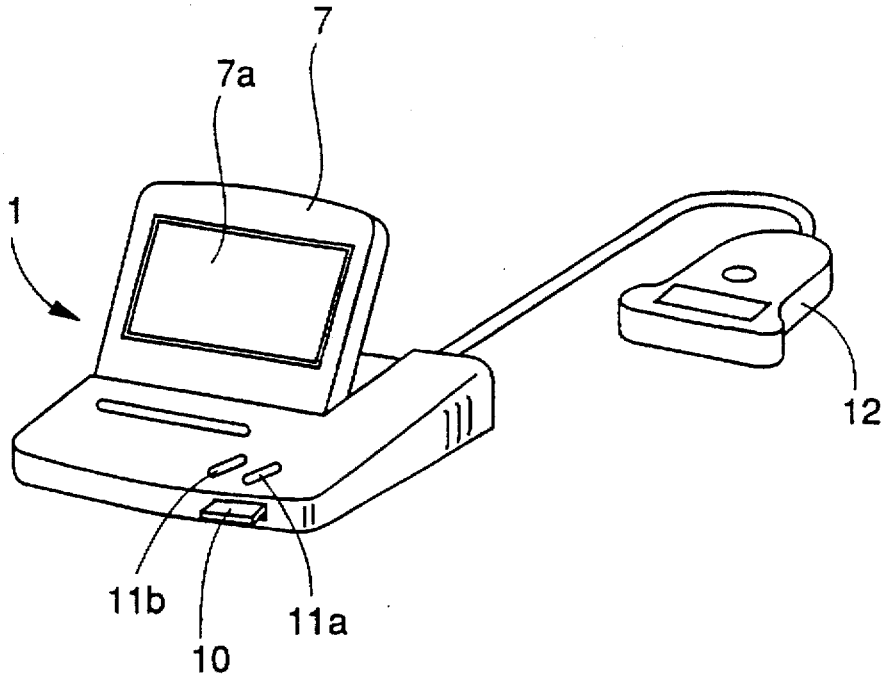
FIG. 1 is a perspective view of an embroidery data processing apparatus to which the present invention is applied.
Figure 10:
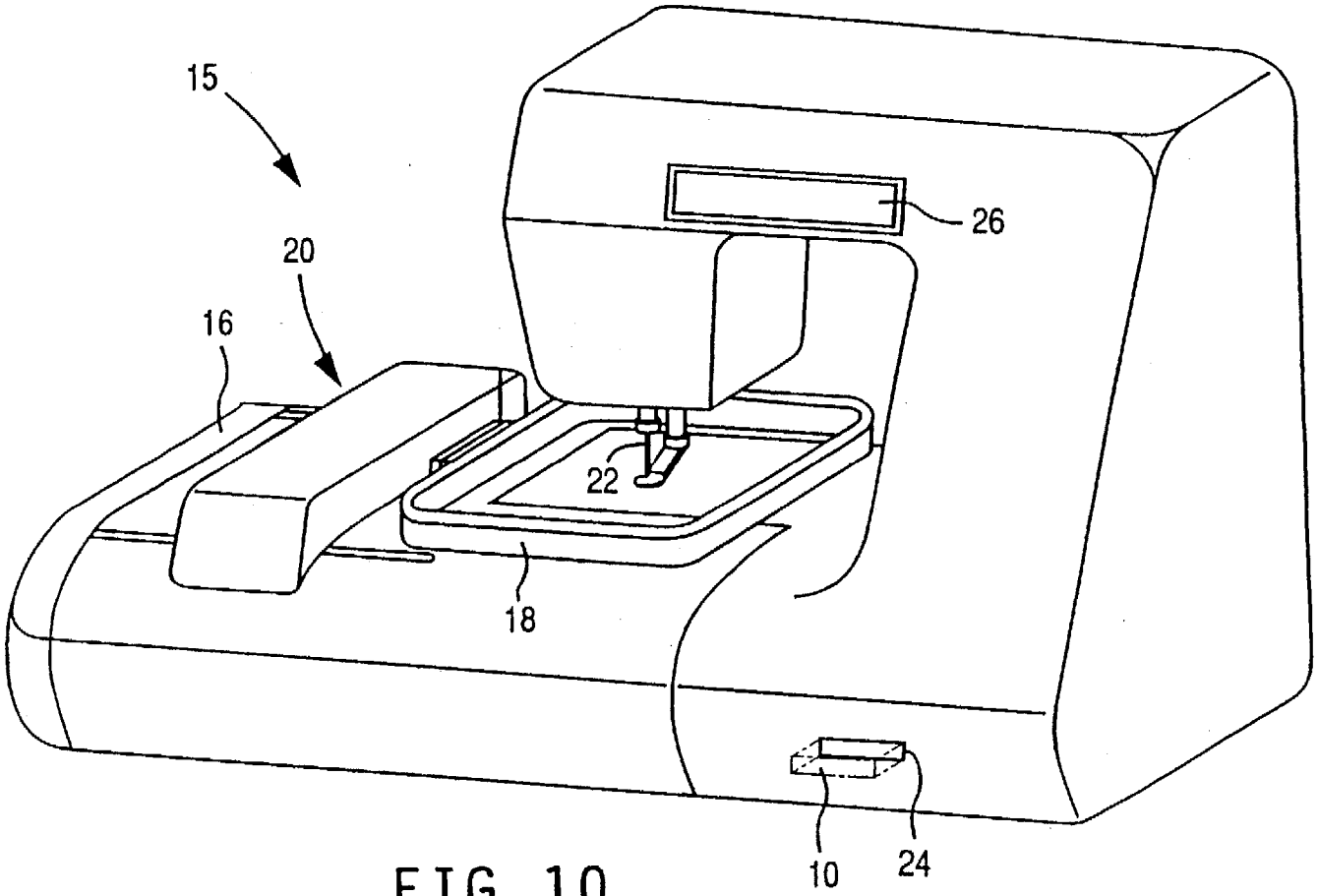
FIG. 10 is a view of a home-use embroidery sewing machine which automatically forms an embroidery on a work sheet by utilizing the embroidery data processed by the apparatus of FIG. 1.
Figure 11A:
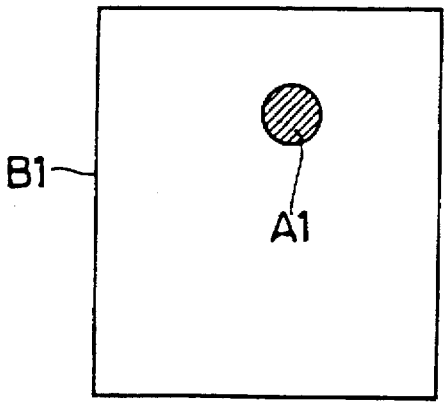
FIG. 11(A) PRIOR ART
FIG. 11(A) is a view of a first part-original sheet prepared in a conventional embroidery-data processing method.
Figure 11B:
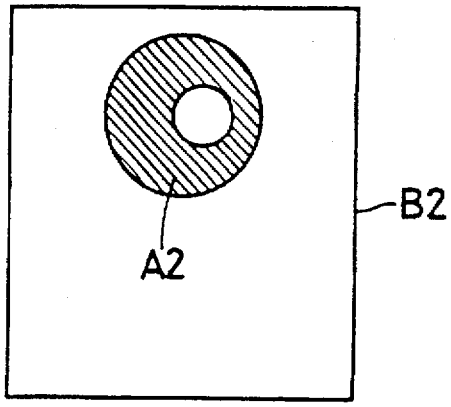
FIG. 11(B) PRIOR ART
FIG. 11(B) is a view of a second part-original sheet prepared in the conventional method.
Figure 11C:
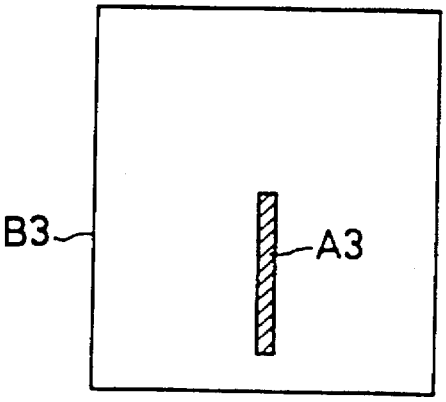
FIG. 11(C) PRIOR ART
FIG. 11(C) is a view of a third part-original sheet prepared in the conventional method.
Figure 11D:
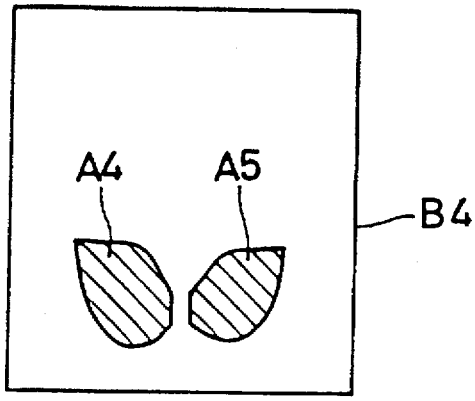
FIG. 11(D) PRIOR ART
FIG. 11(D) is a view of a fourth part-original sheet prepared in the conventional method.

FIG. 10 shows the home embroidery sewing machine 15 which forms the color embroidery corresponding to the original image A, according to the embroidery data processed by the apparatus 1 of FIG. 1. The sewing machine 15 includes a bed 16; a frame 18 for supporting a work sheet; an X–Y feed mechanism 20 for displacing the frame 18 or the work sheet to any position in a horizontal plane defined by the X–Y coordinate system prescribed for the sewing machine 15; a sewing needle 22 for conveying a color embroidery thread (not shown) that is changeable with a different needle thread having a different color, by a user; a loop catcher (not shown) disposed under the bed 16 for catching a loop of the thread conveyed by the needle 22; a drive mechanism (not shown) for vertically reciprocating the needle 22, and rotating the loop catcher, in synchronism with each other; and a control device (not shown) which includes a microcomputer and operates for controlling the feed and drive mechanisms to form the color embroidery corresponding to the original image A, on the work sheet, according to the embroidery data processed by the apparatus 1 of FIG. 1.

The embroidery data processed by the apparatus 1 include sets of stitch-position data (e.g., X and Y coordinate data) which represent respective stitch positions where the sewing needle 22 penetrates the work sheet to form corresponding stitches. Each set of stitch-position data represents respective amounts of movement of the work sheet or the embroidery frame 18 along the X and Y axes to form a corresponding stitch.

As shown in FIG. 10, the sewing machine 15 has a data reading device 24 for reading embroidery data from a flash-memory card 10. A flash memory is an EEPROM (electrically erasable and programmable read only memory). The present apparatus 1 processes embroidery data and stores or records the processed embroidery data in the flash-memory card 10. Alternatively, the apparatus 1 may directly be connected via a data cable to the sewing machine 15, so that the embroidery data produced by the apparatus 1 can directly be transferred to the control device of the sewing machine 15. Otherwise, the apparatus 1 as a whole may be incorporated into the sewing machine 15 of FIG. 10.

The sewing machine 15 has a display device 26 for displaying various messages directed to the user, for example, a message requesting the user to change the current needle thread with a new thread having a different color from that of the current thread.

Figure 2:
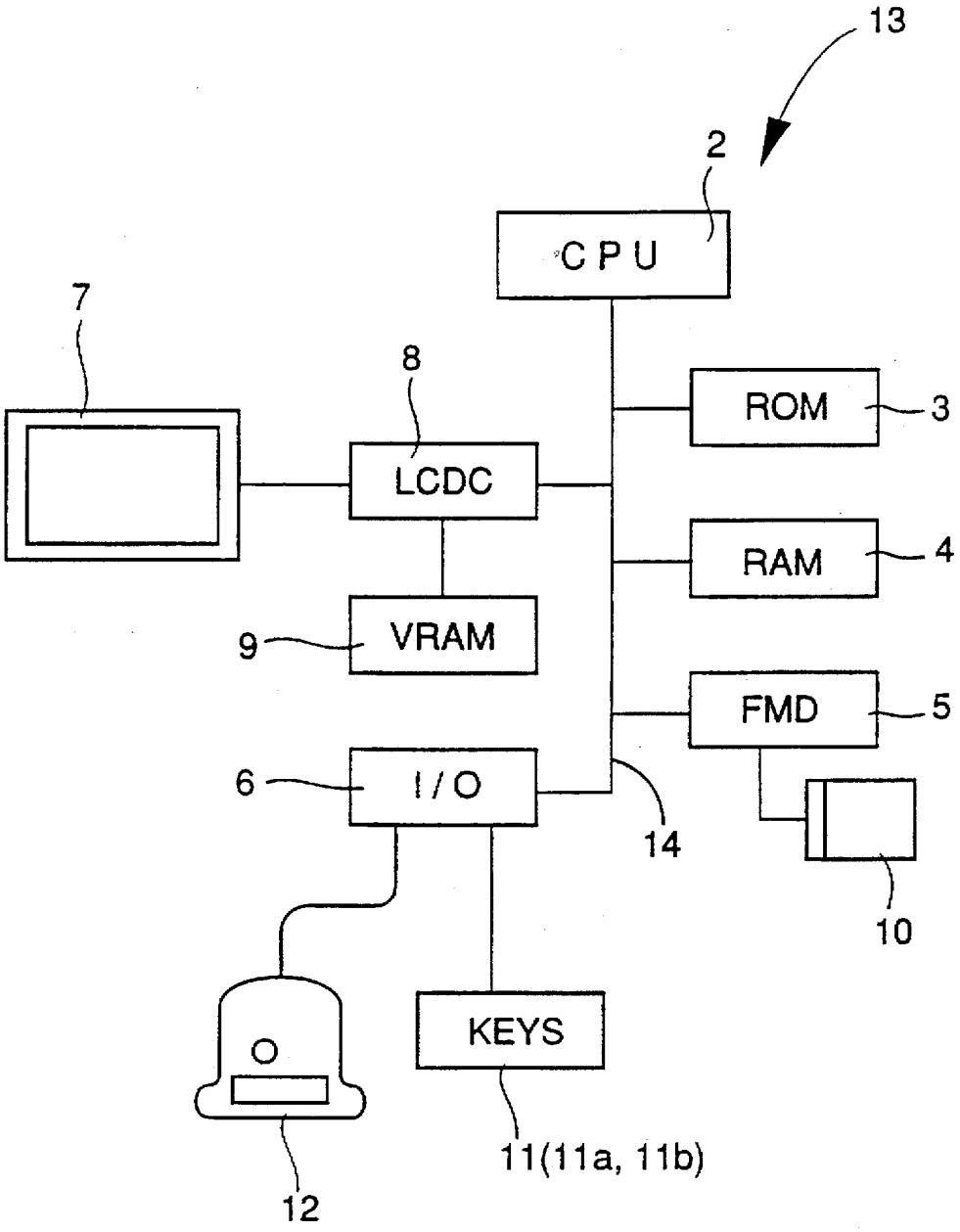
FIG. 2 is a diagrammatic view of the electric arrangement of the apparatus of FIG. 1.
Figure 4:
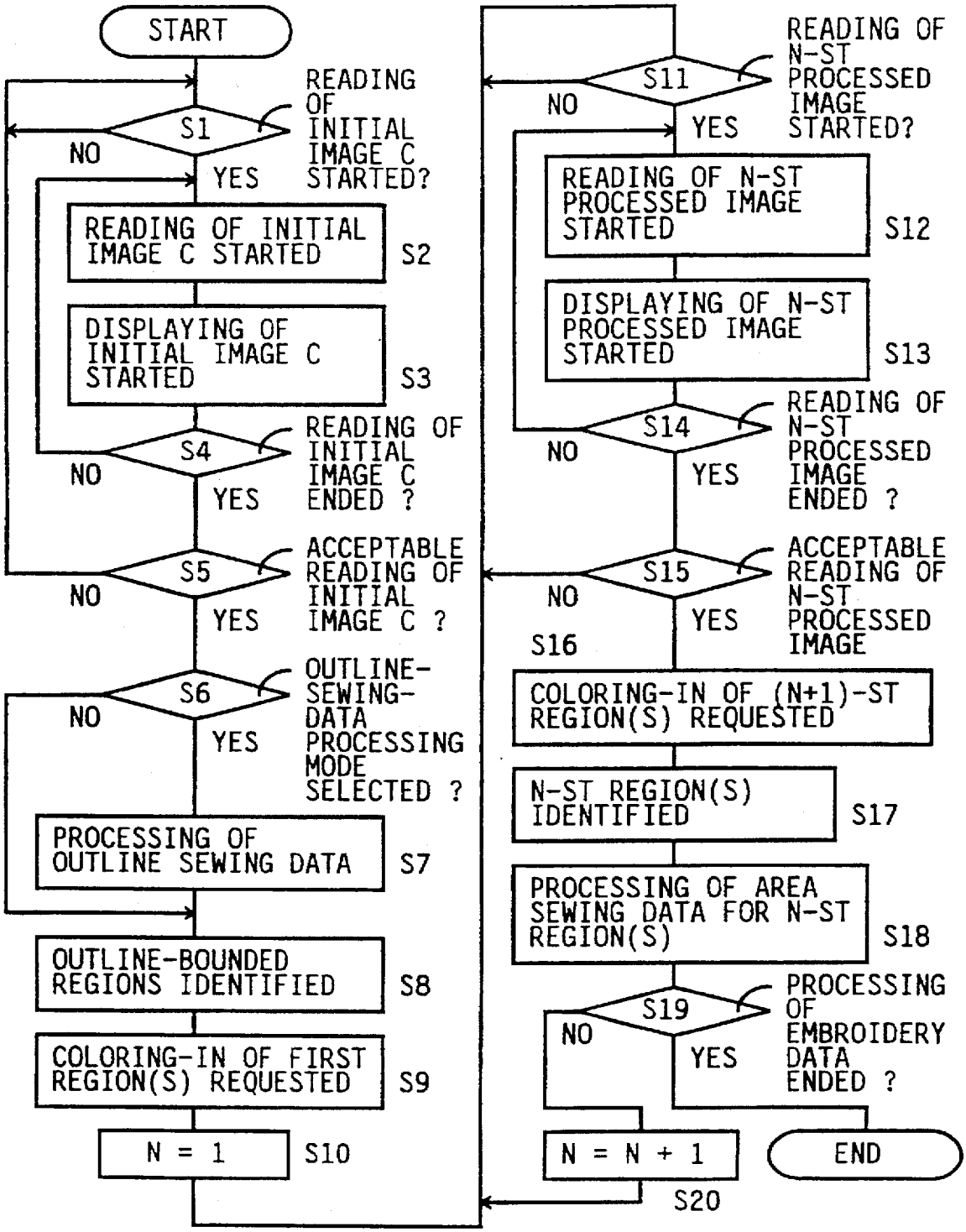
FIG. 4 is a flow chart representing a control program according to which the apparatus of FIG. 1 operates for processing embroidery data.

Next, the electric arrangement of the embroidery data processing apparatus 1 will be described in detail by reference to FIG. 2. The apparatus 1 includes a control device 13 which is essentially constituted by a microcomputer including a central processing unit (CPU) 2, a read only memory (ROM) 3, and a random access memory (RAM) 4. The control device 13 controls various operations of the present apparatus 1. A control program represented by the flow chart of FIG. 4 is pre-stored in the ROM 3. The apparatus 1 additionally includes a flash-memory device (FMD) 5 and an input and output (I/O) interface 6 each of which is connected via bus 14 to the control device 13. The FMD 5 holds the flash-memory card 10 as an external memory. The flash-memory card 10 can be removed from the FMD 5 of the apparatus 1, so that the card 10 may be inserted into the data reading device 24 of the sewing machine 15 of FIG. 10.

As shown in FIG. 1, the present apparatus 1 has, on the top thereof, a liquid crystal display (LCD) 7 having a screen 7*a* for providing a representation of the original image A taken by an image scanner 4 from the original sheet B. The LCD 7 is controlled by a display control device (LCDC) 8 connected to the control device 13. A display-data memory such as a video RAM 9 is connected to the LCDC 8 and the control device 13. Additionally, the apparatus 1 has two keys 11 (11*a*, 11*b*) which are manually operable by the user for inputting his or her "YES" and "NO" answers, respectively, to each of various questions displayed on the screen 7*a* of the LCD 7. The keys 11*a*, 11*b* are connected via the I/O interface 6 to the control device 13.

The image scanner 12 picks up the original image A from the original sheet B. The image scanner 12 is connected to the control device 13 via the I/O interface 6. In the present embodiment, the image scanner 12 is a hand-operable scanner which reads, from the original sheet B, the achromatic original image A provided in white and black colors only. With the upper portion of the scanner 12 being held by the palm of the user, the lower portion (i.e., reading head) of the scanner 12 is rolled over the original sheet B. With a button (not shown) of the scanner 12 being pushed by a finger of the user, the scanner 12 is moved slowly in one direction over the original image A. Thus, the original image A is obtained as raster-type digital image data or bit-map data containing sets of picture-element data corresponding to a number of picture elements of the original image A. Each set of picture-element data is a set of one-bit data representing a value of "0" or "1" defining the white or black color of a corresponding picture element. The image scanner 12 serves as an image reader which reads the original image A from the original sheet B and produces image data defining the original image A. The thus obtained image data are temporarily stored in the RAM 4.

According to the software program pre-stored in the ROM 3 and represented by the flow chart of FIG. 4, the present apparatus 1 automatically produces, from the original image A taken from the original sheet B, embroidery data to form an embroidery corresponding to the original image A. As described in detail later, the apparatus 1 carries out the following steps: the step of producing, from the original sheet B having the original image A including the outline-bounded regions A1 to A5, image data including (a) outline data defining an outline of each region A1 to A5 and (b) area data defining an inside area of each region A1 to A5; the step of selecting an outline-sewing-data processing mode in which outline sewing data to sew the outline of each region A1 to A5 are processed based on the outline data; the step of producing, in the selected outline-sewing-data processing mode, the outline sewing data to form stitches along the outline of each region A1 to A5, based on the outline data; and the step of producing, based on the area data, area sewing data to form stitches filling the inside area of each region A1 to A5. Thus, the embroidery data include the outline sewing data and the area sewing data. The step of selecting the outline-sewing-data processing mode is carried out in response to user's operation of the "YES" key 11*a*, in a manner described later.

Moreover, as described in detail later, the step of producing the image data is carried out in the following substeps: the first substep at which the image scanner 12 is used to read the outline of each region A1 to A5 from the original sheet B having the outline of each region A1 to A5, so as to produce the outline data defining the outline of each region A1 to A5; the second substep at which user's first processing of the original image A is carried out by forming, using an image-forming material such as a black ink, a readable image or images in the inside area or areas of one or more first regions selected by the user from the regions A1 to A5 of the original image A, so as to read, using the image scanner 12, the thus obtained first processed original image and produce first processed-image data defining the first processed original image; the third substep at which user's second processing of the original image A is effected by forming a readable image or images in the inside area or areas of one or more second regions selected by the user from the regions A1 to A5 of the original image A, so as to read, using the image scanner 12, the thus obtained second processed original image and produce second processed-image data defining the second processed original image; and the fourth substep at which the first region(s) is/are identified based on a difference between the first processed-image data and the outline data, so as to produce first region data defining the first region(s), and the second region(s) is/are identified and distinguished from the first region(s), based on a difference between the second processed-image data and the first processed-image data, so as to produce second region data defining the second region(s). Thus, the image data include the first and second region data defining the first and second regions distinguished from each other and from the other regions. The first group of region(s) is/are selected by the user from the regions A1 to A5, so as to embroider with a first needle thread having a first color, whereas the second region(s) is/are selected by the user from the regions A1 to A5, so as to embroider with a second needle thread having a second color different from the first color. The third and fourth substeps may be repeated to produce third region data defining one or more third regions selected by the user from the regions A1 to A5. In the latter case, the image data include the first, second, and third region data defining the first, second, and third groups of regions distinguished from one another. The third region(s) is/are selected by the user from the regions A1 to A5, so as to embroider with a third needle thread having a third color different from the first and second colors. In the present embodiment, in addition to the region A as the first region(s), the region A2 as the second region(s), and the region A3 as the third region(s), the two regions A4 and A5 are selected as fourth regions by the user from the regions A1 to A5, so as to embroider with a fourth needle thread having a fourth color different from the first to third colors.

Next, there will be described the operation of the embroidery data processing apparatus 1 constructed as described above, by reference to the flow chart of FIG. 4 as well as FIG. 3 and FIGS. 6(A), 6(B), 6(C), 6(D). The following description relates to the operation of the apparatus 1 for processing embroidery data for, e.g., the original image A shown in FIG. 5.

Figure 6A:
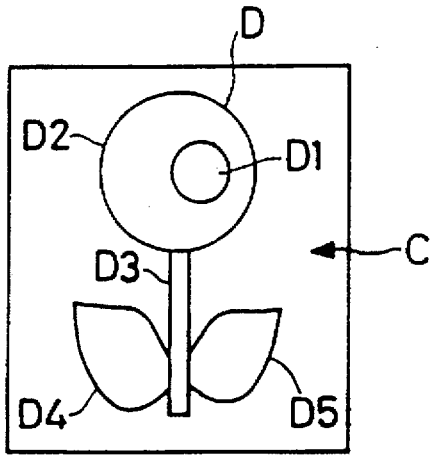
FIG. 6(A) is a view of an initial original image, C, which is read by the image scanner to produce outline-defining data.

Before starting the operation of the apparatus 1, the user prepares the original sheet B having an initial original image, C, consisting of outlines and boundary lines of the original image A, as shown in FIG. 6(A). The initial original image C is obtained by drawing, using a black-ink pen, respective outlines D1, D2, D3, D4, and D5, of the five outline-bounded regions A1 to A5, on the white base sheet B. The outlines D1 to D5 include boundary lines at which two regions (regions D1 and D2; D2 and D3; D3 and D4; and D3 and D5) are contiguous with each other. The black ink or black color coming out of the pen being used is readable or detectable by the achromatic-image scanner 12.

More specifically described, the initial original image C includes the outline D1 of the region A1 as the center of the flower of the plant; the two outlines D1, D2 of the region A2 as the petal of the flower; the outline D3 of the region A3 as the stem of the plant; the outline D4 of the region A4 as the left-hand leaf of the plant; and the outline D5 of the region A5 as the right-hand leaf of the plant. The outline D1 is not only the outline of the region A1 but also one of the two outlines of the region A2, therefore the outline D1 is the boundary line of the two regions A1 and A2.

Upon application of electric power to the present apparatus 1, the CPU 2 of the control device 13 accesses the embroidery-data processing program pre-stored in the ROM 3 and represented by the flow chart of FIG. 4. First, at Step S1 of FIG. 4, the CPU 2 operates for controlling the LCD 7 to display, on the display screen 7*a*, a message requesting the user to start reading the initial original image C from the original sheet B, e.g., "START READING INITIAL ORIGINAL IMAGE". In response to this message, the user starts the image scanner 12 in the above-described manner to read the initial original image C from the original sheet B that has been prepared in advance. Before this operation is started, negative judgments are made at Step S1, so that the CPU 2 repeats Step S1. Meanwhile, if the image-reading operation is started, a positive judgment is made at Step S1, so that the control of the CPU 2 proceeds with Step S2 to start reading the initial original image C from the original sheet B, and start producing outline data representing the outlines D1 to D5 of the initial image C. The thus produced outline data include bit-matrix or bit-map data representing the white or black color of each of the picture elements of the initial image C taken from the original sheet B. Step S2 is followed by Step S3 to provide, on the LCD 7 (i.e., screen 7*a*), a visual representation of the read initial image C, based on the produced outline data or bit-map data. The displaying of the initial image C on the LCD 7 is carried out concurrently with the reading of the same C by the image scanner 12 from the original sheet B. At the following Step S4, the CPU 2 judges whether the reading of the initial image C, i.e., the production of the outline data has been completed. Before the image scanner 12 has been moved by a prescribed distance, negative judgments are made at Step S4, so that the control of the CPU 2 goes back to Step S2. On the other hand, when the image scanner 12 has been moved by the prescribed distance, a positive judgment is made at Step S4. At this time, the entire initial image C should have already been displayed on the LCD 7. Hence, at the following Step S5, the CPU 2 operates for controlling the LCD 7 to provide, together with the initial image C, a message requesting the user to judge whether the initial image C has been read correctly. If the user judges that the initial image C has been read correctly, he or she pushes the "YES" key 11*a*, so that the control of the CPU 2 goes to Step S6. Thus, the production of the outline data is ended. On the other hand, if the user does not judge that the initial image C has been read correctly, he or she pushes the "NO" key 11*b*, so that the control of the CPU 2 goes back to Step S1.

At Step S6, the CPU 2 operates for controlling the LCD 7 to display a message requesting the user to decide whether or not to select the outline-sewing-data processing mode, e.g., message "OUTLINE SEWING IS NEEDED ?". At this step, the user can select, or not select, the operation mode in which outline sewing data to form stitches along the outlines D1 to D5 of the original image A are processed based on the outline data. When the user selects this mode, he or she pushes the "YES" key 11*a*. On the other hand, when not, the user pushes the "NO" key 11*b*. In the former case, a positive judgment is made at Step S6, and the control of the CPU 2 goes to Step S7 to produce outline sewing data based on the outline data obtained at Step S2. The outline data are so modified as to define the center line of each "thick" outline D1 to D5 (having a width corresponding to a plurality of picture elements), according to a known bit-map data processing technique. Otherwise, the outline data may be so modified as to define an outer or inner peripheral line of each "thick" outline D1 to D5, according to a known technique. Based on the thus modified outline data, the control device 13 produces sets of vector data defining short straight segments connected to one another at points located on each outline D1 to D5, according to another known bit-map data processing technique. The short straight segments cooperate with one another to define each outline D1 to D5. The thus produced outline sewing data may be sewing data to form zigzag stitches along the outlines D1 to D5 of the regions A1 to A5. The outline sewing data may include sets of stitch-position data representing stitch positions located on both sides of the outlines D1 to D5, so that the zigzag stitches are formed along the outlines D1 to D5 as reference lines. Other than zigzag-stitch sewing, single-, double-, or triple-stitch sewing, or E-stitch sewing may be employed to embroider the outlines D1 to D5. The produced outline sewing data are stored or recorded in the flash-memory card 10 being inserted in the FMD 5. Step S6 may be so modified as to enable the user to choose whether or not to produce outline sewing data, with respect to the outline(s) of each of the regions A1 to A5. In this modified manner, outline sewing data are produced for a boundary line such as the outline D1, if the user chooses to sew the outline(a) of at least one of the two regions contiguous with each other at that boundary line. On the other hand, if the user pushes the "NO" key 11*b* and a negative judgment is made at Step S6, the control of the CPU 2 skips Step S7 and goes to Step S8.

At Step S8, the CPU 2 operates for identifying the inside area of each of the five outline-bounded regions A1 to A5 of the original image A of FIG. 5, based on the outline data representing the outlines D1 to D5 of FIG. 6(A), and producing area data (bit-map data) representing the inside area of each region A1 to A5, according to known bit-map data processing techniques. Only with the thus produced area data, however, the CPU 2 or the control device 13 cannot automatically judge whether the inside area of a region (e.g., A1) completely contained inside the outline of another region (e.g., A2) is to be embroidered, or, cannot judge, if the former region is to be embroidered, whether the former region is to be embroidered with the same needle thread, i.e., in the same color, as that for the latter region. Additionally, the CPU 2 cannot judge whether the respective inside areas of a plurality of regions are to be embroidered with a common thread, i.e. in a common color, or with different threads having different colors. For example, the CPU 2 cannot judge whether the inside area of the region A1 completely contained inside the outline D2 of the region A2 is an area to be embroidered, or an area not to be embroidered and just to define the inner periphery of the region A2. It goes without saying that the CPU 2 cannot know the user's intention assumed in the present embodiment that the regions A1, A2, A3 are embroidered in different colors, respectively, and the regions A4, A5 are embroidered in a common color which is different from the three colors for the three regions A1 to A3.

Hence, at Step S9 and the following steps, the present apparatus 1 produces two or more sets of processed-image data (described later), and distinguishes one or more first regions each to be embroidered in a first color, from one or more second regions to be embroidered in a second color different from the first color, and, if appropriate, from other regions to be embroidered in other colors different from the first and second colors.

Figure 6B:
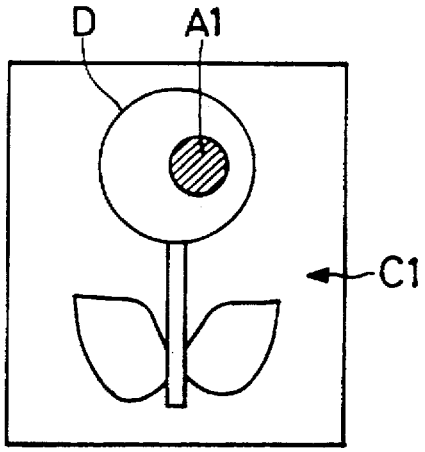
FIG. 6(B) is a view of a first processed original image, C1, which is read by the image scanner to produce first processed-image data.

At Step S9, the CPU 2 operates for controlling the LCD 7 to display a message requesting the user to color in one or more first regions to be embroidered with a needle thread having a first color, i.e., message "COLOR IN REGION(S) TO BE SEWN IN FIRST COLOR". In response to this message, the user colors in one or more regions selected from the regions A1 to A5, using a black-ink pen, for example. Other sorts of image-forming materials may be used. For example, a color tape may be employed in place of a color-ink pen. This coloring-in or blacking-out need not be carried out in a complete manner, that is, only an almost or major portion of the selected region or each of the selected regions needs to be colored in or blacked out. In addition, the user is allowed to erroneously color in a small portion of another region or other regions adjacent to the selected region or regions but not to be selected, for the reasons described later. When the user colors in the inside area of the outline D1 of the region A1, the initial original image C is initially processed into a first processed original image, C1, as shown in FIG. 6(B). Step S9 is followed by Step S10 to set a counter, N, to N=1. The state of N=1 indicates that the first processed original image C1 including the processed region A1 as the first region(s) to be embroidered in the first color, is read in the current control cycle of Steps S11 to S15.

Figure 6C:
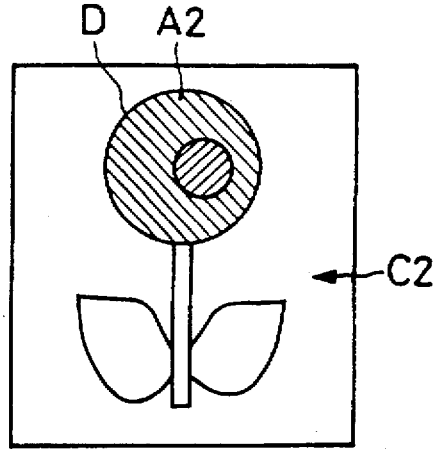
FIG. 6(C) is a view of a second processed original image, C2, which is read by the image scanner to produce second processed-image data.
Figure 6D:
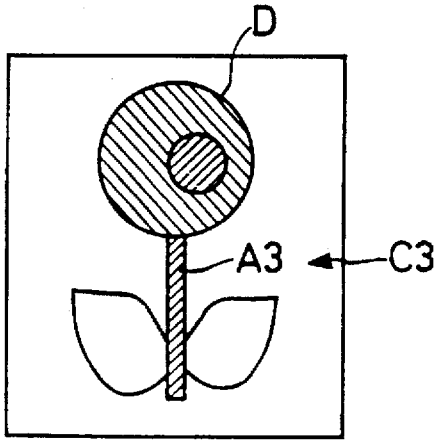
FIG. 6(D) is a view of a third processed original image, C3, which is read by the image scanner to produce third processed-image data.
Figure 6E:
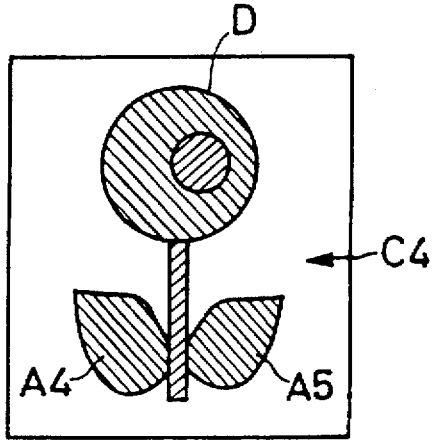
FIG. 6(E) is a view of a fourth processed original image, C4, which is read by the image scanner to produce fourth processed-image data.

At Steps S11 to S15, the present apparatus 1 operates for producing an N-st set of processed-image data from the first processed original C1 (N=1) or each of second to fourth processed originals C2, C3, C4 (N=2, 3, 4) shown in FIGS. 6(C), 6(D), 6(E). Steps S11 to S15 are carried out in substantially the same manner as Steps S1 to S5. In short, the CPU 2 operates for controlling the LCD 7 to display a message "START READING N-ST PROCESSED ORIGINAL IMAGE". In response to this message, the user operates the image scanner 12 to read the N-st processed original image (for the first time, the first processed original C1) and produce the N-st set of processed-image data based on the read N-st processed original image. The N-st processed-image data are bit-map data. The read N-st processed original image is displayed on the LCD 7 based on the N-st processed-image data. When the user judges on the screen 7*a* of the LCD 7 that the N-st processed original image has been read correctly, he or she pushes the "YES" key 11*a*, so that the control of the CPU 2 goes to Step S16.

Figure 3:
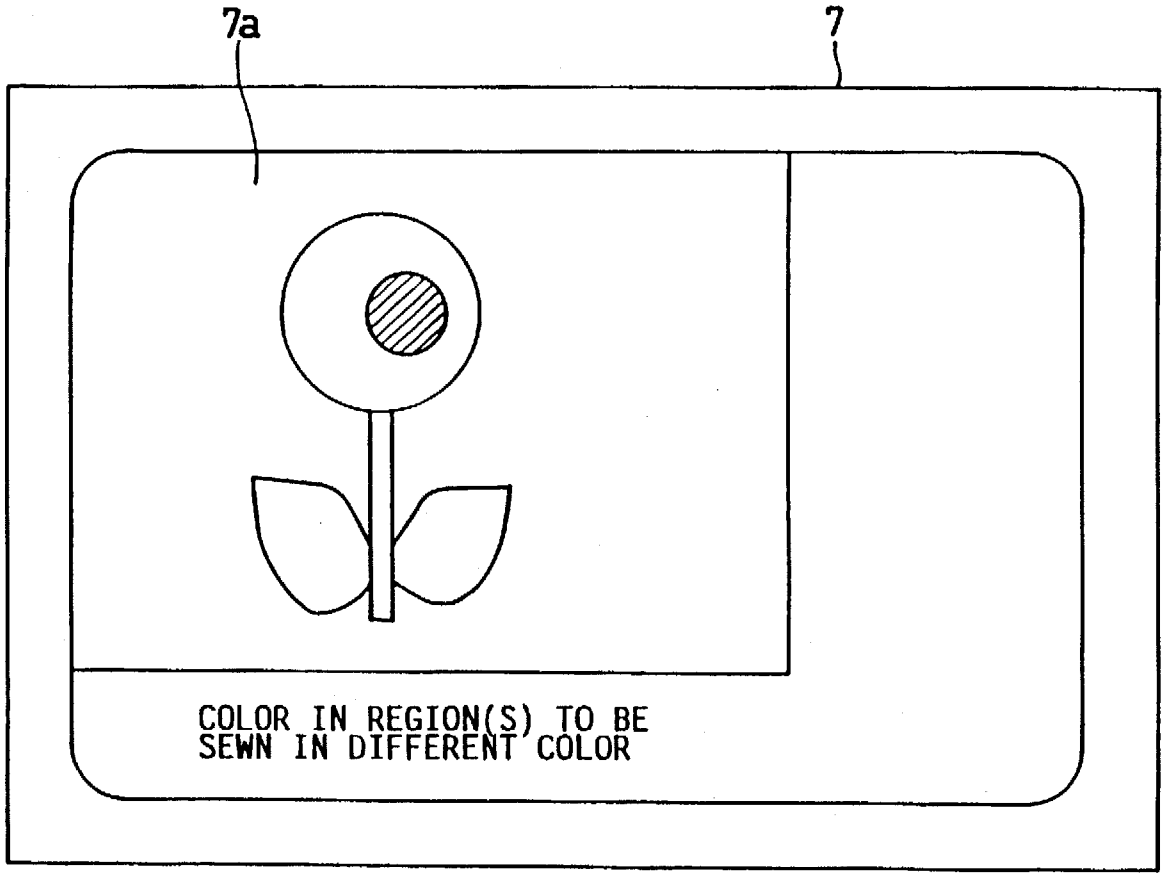
FIG. 3 is a view of an image and a message displayed on a screen of a liquid-crystal display of the apparatus of FIG. 1.

At Step S16, the CPU 2 operates for controlling the LCD 7 to display, on the screen 7*a*, a message requesting the user to color in region(s) to be embroidered in a different color, e.g., message "COLOR IN REGION(S) TO BE SEWN IN DIFFERENT COLOR", as shown in FIG. 3. This message is not deleted during the duration in which the following Steps S17 and S18 are carried out.

At Step S17, the CPU 2 identifies and distinguishes the N-st processed region(s) to be embroidered in the N-st color, from the other regions to be embroidered in the other colors. Specifically described, at Step S17, the CPU 2 identifies which region(s) out of the regions A1 to A5 has/have been read as the N-st processed region(s), based on the area data obtained at Step S8 and the N-st set of processed-image data obtained at Step S12, and produces an N-st set of region data defining the N-st processed region(s) based on the difference between the N-st set of processed-image data obtained at Step S12 in the current control loop of Steps S11 to S20 and an (N−1)-st set of processed-image data obtained at Step S12 in the preceding control loop of the same steps. However, the CPU 2 produces a first set of region data defining the first processed region(s), based on the difference between the area data obtained at Step S8 and the first set of processed-image data obtained at Step S12. Regarding the original image A, the present apparatus 1 produces the first set of region data defining the region A1, based on the first set of processed-image data.

The CPU 2 judges whether each region A1 to A5 is colored in, or covered, with the black ink of the pen, by identifying whether a percentage of the area (i.e., number of picture elements) of the colored-in portion of each region to the total area of the same is greater than a threshold value. Different threshold values are employed for large, medium, and small regions, respectively. For example, for the large regions, 50% is used as the threshold value; for the medium regions, 75% is used; and for the small regions, 90% is used. Therefore, even though the coloring-in or blacking-out may not be carried out in a complete fashion, the control device 13 or CPU 2 reliably identifies the region or regions colored in by the user with the black pen.

Step S17 is followed by Step S18 to produce area sewing data to form stitches filling the inside area(s) of the N-st processed region(s), based on the N-st set of region data obtained at Step S17. In the present embodiment, an N-set of region data include region-area data defining the inside area(s) of the N-st region(s). Otherwise, region-outline data defining the outline(s) of the N-st region(s) may be produced in place of the region-area data. The region-outline data may be produced based on the region-area data, and vice versa. There are known various techniques for producing, directly from region-area data as bit-map data, sets of stitch-position data representing stitch positions where the needle 22 of the sewing machine 15 penetrates a work sheet, and there are also known various techniques for producing, based on region-outline data, sets of stitch-position data representing stitch positions. Therefore, detailed description of the manner of production of the area sewing data is omitted. The thus produced area sewing data to be used to embroider the N-st region(s) in the N-st color, are recorded together with the outline sewing data obtained at Step S7, in the flash-memory card 10.

During the time duration in which the apparatus 1 carries out Steps S17 and S18, the user can further process the previously processed original image from which the N-st processed region(s) has/have been read, i.e., color in one or more (N+1)-st region(s) to be embroidered in the (N+1)-st color, using the black pen, in response to the message provided on the LCD 7 at Step S16. Thus, for example, the first processed original image C1 is further processed into the second processed original image C2 shown in FIG. 6(C), by coloring in the region A2 as the second processed region(s) to be embroidered in the second color.

Step S18 is followed by Step S19 at which the CPU 2 operates for controlling the LCD 7 to display a message asking the user whether to end the current embroidery-data processing operation, e.g., message "THE CURRENT OPERATION IS ENDED ?" The user pushes the "YES" key 11*a* or the "NO" key 11*b*. In the case where the user ends the current operation by pushing the "YES" key 11*a*, the current control cycle in accordance with the flow chart of FIG. 4 is finished. On the other hand, in the case where the user continues to read another or other processed original image (s) and produce another or other set(s) of area sewing data, he or she pushes the "NO" key 11*b*, so that a negative judgment is made at Step S19 and so that the control of the CPU 2 goes to Step S20 to add one to the counter N, and subsequently goes back to Step S11 and the following steps.

The second processed original image C2 has the two regions A1 and A2 colored in with the black ink. Therefore, the apparatus 1 produces, at Step S12, a second set of processed-image data defining the regions A1 and A2. At Step S17, however, the control device 13 or CPU 2 distinguishes the second processed region A2 newly colored in and to be embroidered in the second color, from the first processed region A1 previously colored in and to be embroidered in the first color, based on the difference between the second set of processed-image data defining the regions A1 and A2 and the first set of processed-image data defining the region A1. In the same manner, the third and fourth processed original images C3, C4 shown in FIGS. 6(D) and 6(E) are prepared by the user and read by the image scanner 12 so as to produce a third and a fourth set of processed-image data, identify the third processed region A3 and the fourth processed regions A4 and A5, and produce a third and a fourth set of area sewing data. Regarding the fourth processed original image C4, the two regions A4 and A5 are colored in at the same time, so that the apparatus 1 distinguishes, from the first to third processed regions, the fourth processed regions A4, A5 to be embroidered in the fourth color.

The flash-memory card 10 storing the thus produced embroidery data including the outline sewing data and the first to fourth sets of area sewing data, is removed from the FMD 5 of the apparatus 1, and is inserted into the data reading device 24 of the embroidery sewing machine 15 of FIG. 10. According to the embroidery data stored in the flash-memory card 10, the sewing machine 15 automatically forms, on the work sheet held by the frame 18, an embroidery corresponding to the original image A. In the embroidery-forming operation, first, the sewing machine 15 forms stitches to fill the inside area of the region A1, with a thread having a first color selected by the user. Following this sewing operation, the sewing machine 15 stops the needle 22 and displays, on the screen 26, a message requesting the user to change needle threads. In response to this message, the user changes the current thread to a different thread having a second color different from the first color. Subsequently, the user re-starts the sewing machine 15 to form stitches filling the region A2 with the new thread having the second color. Finally, according to the outline sewing data, the sewing machine 15 forms stitches along the outline(s) of each of the regions A1, A2, A3, A4, A5, with a common needle thread having a color identical with, or different from, the four colors of the four threads. Otherwise, the sewing machine 15 may be modified such that, each time the sewing of each of the outlines D1 to D5 is started, the screen 26 displays a message requesting the user to change a current needle thread to a corresponding one of the four threads used to embroider the first to fourth processed regions A1; A2; A3; and A4, A5. The fourth processed original image C4 is prepared by simultaneously coloring in the regions A4 and A5 to embroider with a common thread, so that the two regions A4, A5 are continuously sewn without changing threads.

It emerges from the foregoing description that, in the present embodiment, outline embroidery data to form stitches along the outlines and boundary lines D1 to D5 of the original image A (A1 to A5), are easily produced based on the image data obtained from the initial original image C. In contrast to the conventional method in which a peripheral portion or area of an outline-bounded region is handled as if it were also an outline-bounded region and therefore the total number of part-original sheets to be prepared are increased, the present apparatus 1 easily processes the outline embroidery data directly based on the outline data obtained by reading the initial original image C.

Furthermore, in the present embodiment, the user can select the outline-sewing-data processing mode at Step S6 of FIG. 4. Since the present apparatus 1 can produce, for the original image A, (a) first embroidery data including outline sewing data and (b) second embroidery data not including outline sewing data, the user can enjoy a variety of embroidery data for the original image A. In the modified control manner of Step S6 in which the apparatus 1 permits the user to choose whether to sew an outline or outlines, with respect to each of the regions A1 to A5, the degree of variety of embroidery data for the original image A is much increased. In addition, when the user does not select this mode because he or she judges that outline sewing data are not necessary, the production of embroidery data for the original image A is simplified as compared with the case where outline sewing data are processed whenever embroidery data are processed.

In the present embodiment, the user first prepares the original B having the initial original image C consisting of the outlines and boundary lines D of the original image A, i.e., outlines D1 to D5 of the regions A1 to A5, and then stepwise processes the initial original image C by coloring in the first to fourth region(s) A1, A2, A3, and A4, A5 and thereby providing the first to fourth processed original images C1 to C4. Only with the original images C, C1 to C4 prepared and processed on the single sheet B, the image scanner 12 can stepwise read each of the first to fourth processed original images and produce the first to fourth sets of processed-image data necessary to process embroider data to form an embroidery in multiple colors. Thus, in the present embodiment, the single sheet B suffices in contrast to the conventional method in which the user is required to prepare the four sheets B1 to B4 shown in FIGS. 11(A) to 11(D). Thus, the amount of working of the user is much reduced as compared with the conventional method.

Moreover, the present apparatus 1 employs the achromatic image scanner 12 that costs lower than a chromatic image scanner. Because of the employment of the achromatic image scanner 12, the hardware and software configurations of the apparatus 1 are much simplified.

Furthermore, in the present embodiment, the control device 13 or CPU 2 identifies whether each region A1 to A5 has been colored in with the black pen, by judging whether the percentage of the area of the colored-in portion of each region to the total area of the same is greater than a threshold value. Thus, even if the coloring-in or blacking-out of the inside area of each region may not be carried out in a complete or strict manner, the CPU 2 reliably identifies which region or regions has/have been colored in by the user with the black pen. Therefore, the user can perform the coloring-in of regions, with ease and with efficiency. In addition, since the apparatus 1 provides various helpful messages on the LCD 7, the user can easily use the apparatus 1 for processing embroidery data for a desired original image.

Figure 7:
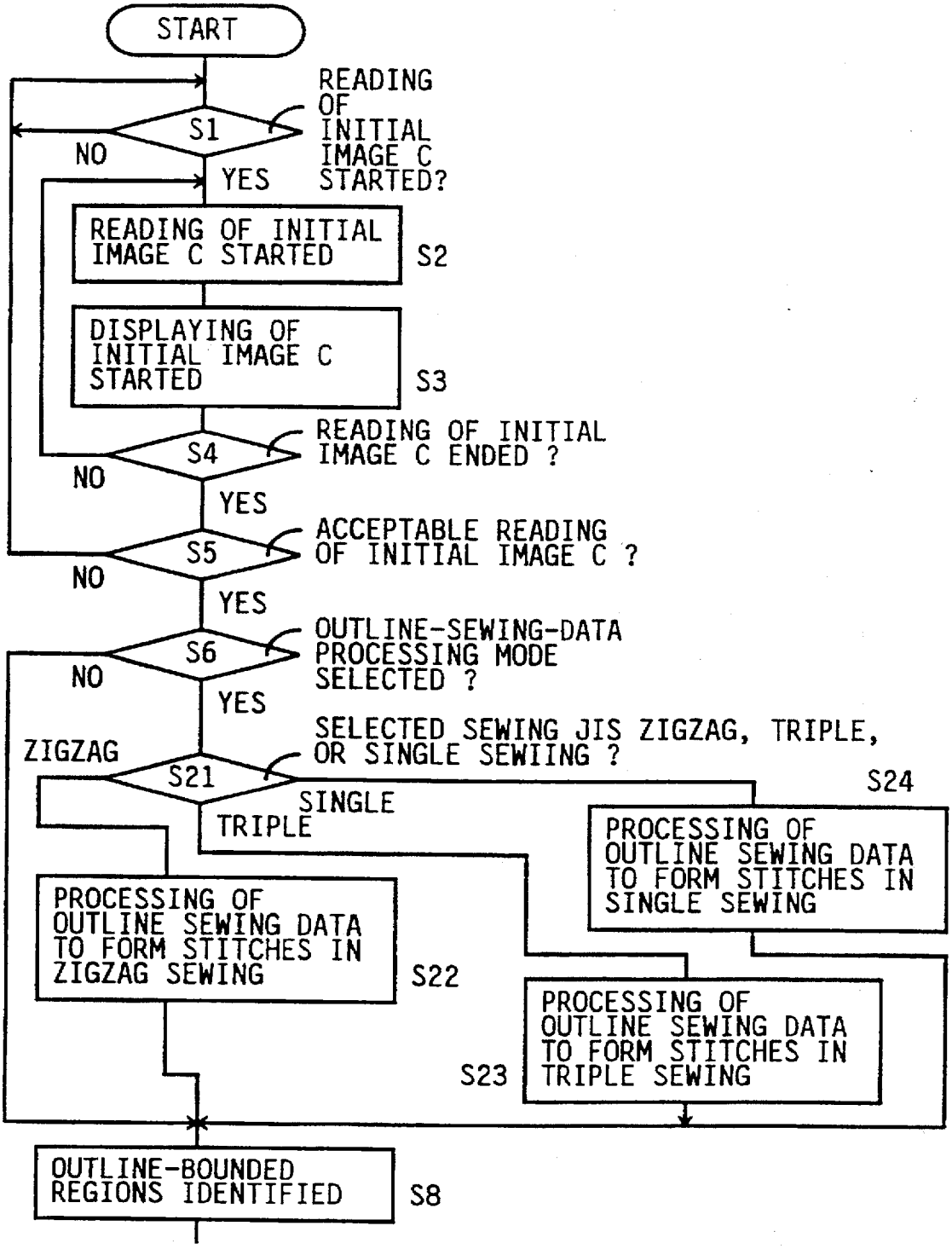
FIG. 7 is a flow chart representing another control program according to which the apparatus of FIG. 1 operates in a second embodiment of the invention.

Next, there will be described a second embodiment of the present invention by reference to the flow chart of FIG. 7. The second embodiment also relates to an embroidery data processing apparatus having the same hardware construction as that shown in FIGS. 1 to 3. Therefore, the same reference numerals as used in FIGS. 1 to 3 are used to designate the corresponding elements or parts of the second apparatus in accordance with the second embodiment. However, the second apparatus operates according to a different control program represented by the flow chart of FIG. 7 and pre-stored in a ROM 2 of a control device 13. The different control program represented by the flow chart of FIG. 7 is obtained by modifying the control program represented by the flow chart of FIG. 4. That is, the flow chart of FIG. 7 includes additional Steps S21, S22, S23, and S24 in place of Step S7 of the flow chart of FIG. 4. Step S9 and the following steps are not shown in FIG. 7. The following description is focused on Steps S21 to S24.

After a user has selected the outline-sewing-data processing mode at Step S6, he or she can select, at Step S21, one of three sewing manners, i.e., zigzag-stitch sewing, triple-stitch sewing, and single-stitch sewing, to form stitches along the outlines D1 to D5 of the regions A1 to A5 of the original image A. The selection of a desired sewing manner is carried out by pushing a screen *7a* of an LCD 7. The user pushes or touches one of three imaged keys displayed on the LCD 7 which correspond to the three sewing manners. In the case where the zigzag sewing is selected at Step S21, the control of a CPU 2 goes to Step S22 to produce outline sewing data to form zigzag stitches along the outlines D1 to D5. The width and pitch of the zigzag stitches can be changed on the screen *7a* of the LCD 7. The zigzag stitches are formed at (a) stitch positions located on both sides of each outline D1 to D5; (b) stitch positions all located on an outer side of each outline; or (c) stitch positions all located on an inner side of each outline. In the case where the triple sewing is selected at Step S21, the control of the CPU 2 goes to Step S23 to produce outline sewing data to form triple stitches along the outlines D1 to D5. The pitch of the triple stitches can be changed on the screen *7a* of the LCD 7. The triple stitches are formed at stitch positions substantially on each outline. In the case where the single sewing is selected at Step S21, the control of the CPU 2 goes to Step S24 to produce outline sewing data to form common, single stitches along each outline D1 to D5. The pitch of the single stitches can be changed on the screen *7a* of the LCD 7. The single stitches are formed at stitch positions on each outline.

In the second embodiment, too, outline sewing data are easily produced if the user wishes to form stitches along the outlines and/or boundary lines of an original image. Additionally, since the user can select, at Step S21, a desired sewing manner from the various sewing manners pre-set in the apparatus, he or she can obtain a variety of sorts of outline sewing data which can be used to form a variety of sorts of outline stitches along the outlines of an original image.

Figure 8:
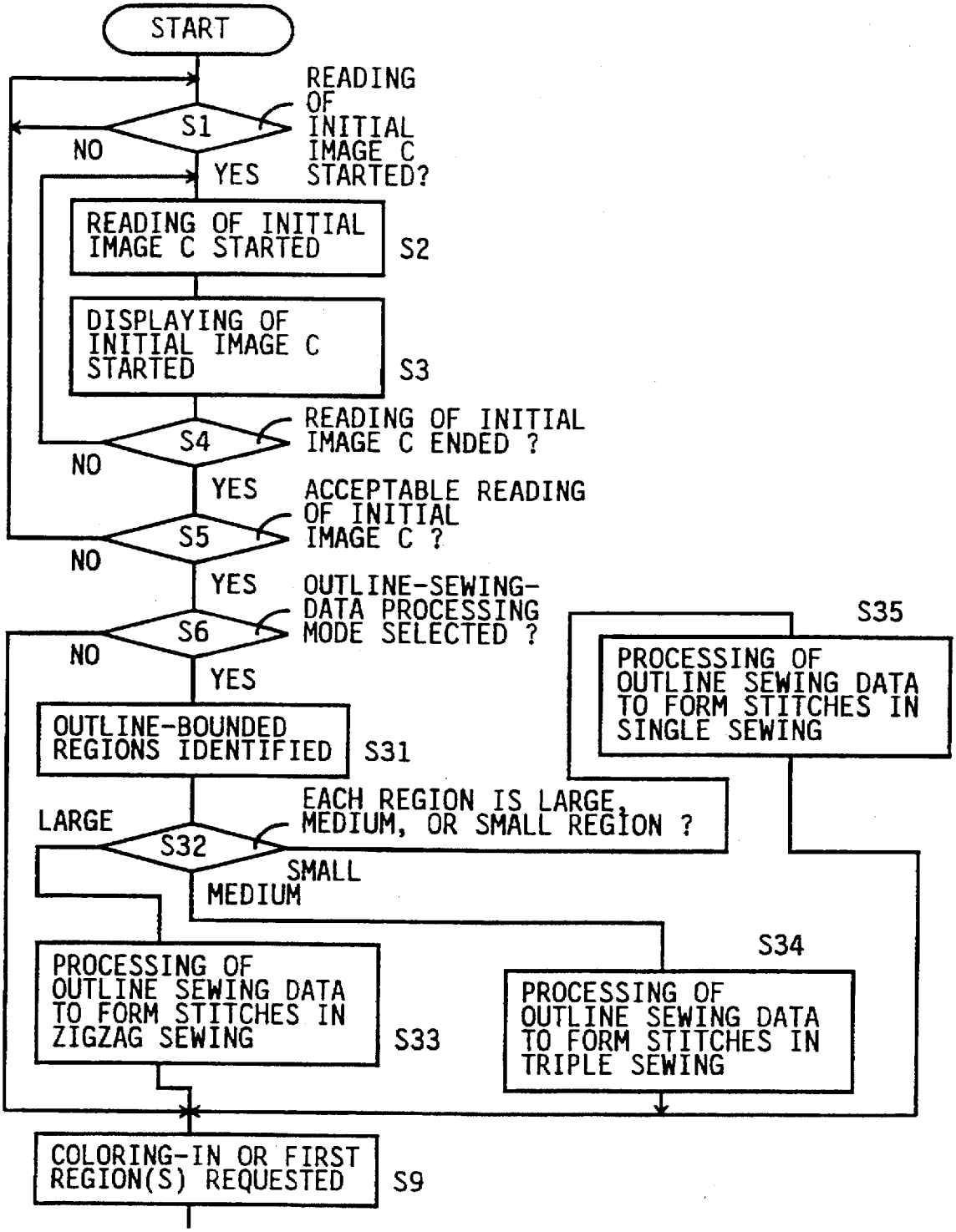
FIG. 8 is a flow chart representing yet another control program according to which the apparatus of FIG. 1 operates in a third embodiment of the invention.

Next, there will be described a third embodiment of the present invention by reference to the flow chart of FIG. 8. The third embodiment also relates to an embroidery data processing apparatus having the same hardware construction as that shown in FIGS. 1 to 3. Therefore, the same reference numerals as used in FIGS. 1 to 3 are used to designate the corresponding elements or parts of the third apparatus in accordance with the third embodiment. However, the third apparatus operates according to a different control program represented by the flow chart of FIG. 8 and pre-stored in a ROM 2 of a control device 13. The different control program represented by the flow chart of FIG. 8 is obtained by modifying the control program represented by the flow chart of FIG. 4. That is, the flow chart of FIG. 8 includes, following Step S6 of FIG. 4, Step S31 corresponding to Step S8 of FIG. 4, and includes additional Steps S32, S33, S34, and S35 in place of Step S7 of FIG. 4. Step S10 and the following steps are not shown in FIG. 9. The following description is focused on Steps S32 to S35.

When a user has selected the outline-sewing-data processing mode at Step S6, the control of a CPU 2 goes to Step S31 corresponding to Step S8 of FIG. 4. At Step S31, the CPU 2 operates for identifying the inside area of each of the five outline-bounded regions A1 to A5 of the original image A of FIG. 5, based on the outline data representing the outlines D1 to D5 of FIG. 6(A), and producing area data defining the inside area of each region A1 to A5. The area data include five sets of bit-map data each of which defines the inside area of a corresponding one of the five regions A1 to A5. Step S31 is followed by Step S32 to calculate the number of the picture elements corresponding to the inside area of each of the regions A1 to A5, based on the sets of bit-map data, i.e., calculates the area of each region A1 to A5. Subsequently, the CPU 2 classifies the regions A1 to A5 into three groups, i.e., large region(s), medium region(s), and small region(s), based on the calculated areas of the regions A1 to A5 and two reference values one of which is the criterion between the large and medium regions and the other of which is the criterion between the medium and small regions. In the case of the large region(s), the control of the CPU 2 goes to Step S33 to produce outline sewing data to form zigzag stitches along the outlines of the large region(s). In the case of the medium region(s), the control of the CPU 2 goes to Step S34 to produce outline sewing data to form triple stitches along the outlines of the medium region(s). In the case of the small region(s), the control of the CPU 2 goes to Step S35 to produce outline sewing data to form single stitches along the outlines of the small region(s).

A larger region enjoys a better appearance with thicker stitches formed along the outline(s) thereof, whereas a smaller region enjoys a better appearance with thinner stitches formed along the outline(s) thereof. Since triple stitches are thinner than zigzag stitches and thicker than single stitches, sets of outline sewing data suitable for various sizes of outline-bounded regions are automatically produced in the third embodiment, without any help or intervention of the user.

While the present invention has been described in its preferred embodiments, the invention may otherwise be embodied.

For example, while in the illustrated embodiments outline sewing data are produced according to a prescribed sewing manner, or an user or automatically selected one of prescribed sewing manners, when the outline-sewing-data processing mode is selected by a user, it is possible to omit the step of selecting this mode and automatically process, without any conditions, outline sewing data to form stitches in a prescribed sewing manner, e.g., triple-stitch sewing. The user can make a final decision as to whether to adopt or discard the thus processed outline sewing data. In addition, it is possible that the outline sewing data processed according to the triple-stitch sewing be replaced with outline sewing data processed according to a user's desired one of zigzag-stitch sewing or single-stitch sewing. This modified manner is carried out according to the flow chart of FIG. 9. In this case, it is possible to modify the flow chart of FIG. 9 in such a manner that a user can choose whether to adopt or discard each portion of the processed outline sewing data, with respect to a corresponding one of the regions A1 to A5, and replace each portion of the outline sewing data processed according to a prescribed sewing manner, with outline sewing data processed according to a user's desired one of different prescribed sewing manners.

Figure 9:
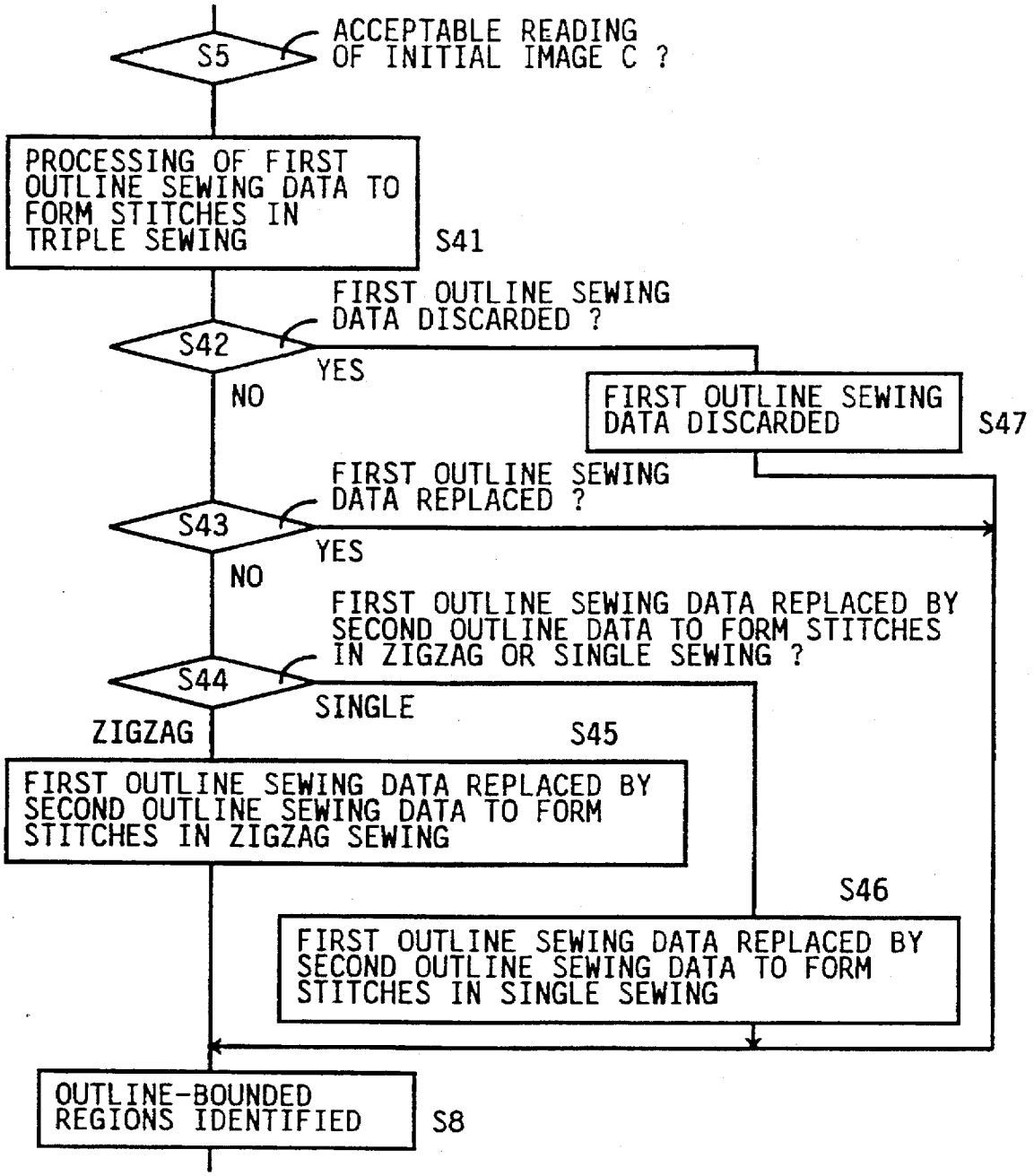
FIG. 9 is a flow chart representing yet another control program according to which the apparatus of FIG. 1 operates in a fourth embodiment of the invention.

Furthermore, Step S41 of FIG. 9 may be modified such that the control device 13 or CPU 2 specifies the triple-stitch sewing as the sewing manner to be used to form stitches along the outlines of the regions A1 to A5. In this case, Step S42 is modified to provide, on the LCD 7, a message asking the user whether to select the triple-stitch sewing. If the user pushes the "YES" key 11*a*, the control goes to Step S47 modified to produce outline sewing data to form stitches in the triple sewing. If the user pushes the "NO" key 11*b*, the control goes to Step S43 modified to provide, on the LCD 7, another message asking the user whether to produce outline sewing data to form stitches along the outlines of the regions A1 to A5. If the "YES" key 11*a* is pushed, no outline sewing data is processed. On the other hand, if the "YES" key 11*b* is pushed, the control goes to Step S44 not modified.

Although in the third embodiment a sewing manner according to which outline sewing data are processed is automatically selected from a plurality of prescribed sewing manners, based on the calculated area of each region A1 to A5, it is possible to automatically choose whether or not to produce outline sewing data, or select a suitable one of prescribed sewing manners, based on the thickness (i.e., number of picture elements) of each outline D1 to D5 of the initial original image C, or the position of each outline D1 to D5 of the same C in the original sheet B.

While in the illustrated embodiments outline sewing data are processed after outline data are produced from the outlines D of the initial original image C, and a set of area sewing data is processed each time an N-st processed region(s) to be embroidered in an N-st color is/are distinguished from the other regions, it is possible to carry out, after the outlines are read and all the processed regions are distinguished, the step of selecting the outline-sewing-data processing mode, the step of producing the outline sewing data, and the step of producing the sets of area sewing data. It is also possible to distinguish each processed region(s) from the other processed regions after all the processed original images C1 to C4 have been read and all the sets of processed-image data have been produced. In the last case, the CPU 2 temporarily stores the outline data and the sets of processed-image data in different memory areas of the RAM 3, respectively.

While in the illustrated embodiments different threshold values are employed for judging whether each of the regions A1 to A5 is colored in with the black-ink pen, it is possible to use a single, constant threshold value or use four or more threshold values. Additionally, in place of the percentage of the area of the colored-in portion of each region to the total area of the same, it is possible to compare the "raw" number of the picture elements of the colored-in portion of each region A1 to A5, with a threshold value. In the latter case, if a very small value is used as the threshold, a user can complete the coloring-in of region(s), by just writing a small black circle or mark in the inside area of each region. A small, cut black tape may be used to add to the selected region(s) and thereby form an achromatic image readable by the image scanner 12.

The principle of the present invention is also applicable to the processing of embroidery data to control a multiple-needle embroidery sewing machine having a plurality of sewing needles. The sewing machine automatically selects and uses one of color-different threads conveyed by the sewing needles, according to the embroidery data. The embroidery-data processing apparatus 1 may be provided by a wide-use personal computer. The hand-operable image scanner 12 may be replaced a wide-use installed-type image reader.

It is to be understood that the present invention may be embodied with other changes, improvements, and modifications that may occur to those skilled in the art without departing from the scope and spirit of the invention defined in the appended claims.

What is claimed is:

1. An apparatus for generating sewing data used to form an embroidery on a work sheet, the apparatus comprising:

an image reader operative to read an original image and to produce at least one set of image data representing the original image, the original image including at least one outline and an inside area defined by the at least one outline;

a first device operative in association with the at least one set of image data to produce outline sewing data for making stitches on the work sheet along the at least one outline; and a second device operative in association with the at least one set of image data to produce area sewing data for making stitches on the work sheet to fill the inside area thereby forming an embroidery of the original image on the work sheet.

2. An apparatus according to claim 1, wherein said image reader comprises means for reading, from said original, said original workpiece image comprising a plurality of outline-bounded regions contiguous with each other, and producing said image data defining an outline of each of said outline-bounded regions, said outline of said each region including a boundary line at which said regions are contiguous with each other.

3. An apparatus according to claim 1, wherein at least one of said first and second devices comprises a first sewing-manner-specifying device which specifies a first sewing manner.

4. An apparatus according to claim 3, wherein said at least one of said first and second devices further comprises first producing means for producing at least one of said outline sewing data and said area sewing data to form stitches in said first sewing manner.

5. An apparatus according to claim 4, wherein said at least one of said first and second devices further comprises an input device which is operable for selecting a mode in which said first producing means does not produce said at least one of said outline sewing data and said area sewing data.

6. An apparatus according to claim 3, wherein said at least one of said first and second devices further comprises:

a second sewing-manner-specifying device which specifies a second sewing manner different from said first sewing manner; and second producing means for producing at least one of said outline sewing data and said area sewing data to form stitches in said second sewing manner.

7. An apparatus according to claim 3, wherein said first sewing-manner-specifying device comprises means for selecting, as said first sewing manner, one of a plurality of sewing manners, based on a characteristic of said outline-bounded region.

8. An apparatus according to claim 3, wherein said first sewing-manner-specifying device comprises an input device which is operable for selecting, as said first sewing manner, one of a plurality of sewing manners.

9. An apparatus according to claim 1, wherein said image reader comprises means for producing said image data comprising at least one of outline-defining data defining said outline of said outline-bounded region and area-defining data defining said inside area of said outline-bounded region.

10. An apparatus according to claim 1, wherein said first device comprises means for producing said outline sewing data to form stitches in a sewing manner selected from the group consisting of zigzag-stitch sewing, single-stitch sewing, double-stitch sewing, triple-stitch sewing, and E-stitch sewing.

11. An apparatus according to claim 1, wherein said second device comprises means for producing said area sewing data to form stitches in a sewing manner selected from the group consisting of satin-stitch sewing, seed-stitch sewing, and multiple-pattern sewing.

12. An apparatus according to claim 1, further comprising a utilizing device which utilizes said outline sewing data and area sewing data to control the sewing machine to form, on the work sheet, said embroidery corresponding to said original image.

13. An apparatus according to claim 12, wherein said utilizing device comprises a stitch-forming device of the sewing machine which forms stitches according to said outline sewing data and area sewing data and thereby produce said embroidery on the work sheet.

14. An apparatus according to claim 12, wherein said utilizing device comprises a recording device which records, in an external memory such as an EEPROM, said outline sewing data and area sewing data to control the sewing machine to form said embroidery on the work sheet.

15. A method of generating embroidery data to control a sewing machine to form an embroidery on a work sheet, the method comprising the steps of:

reading an original image, the original image including at least one outline and an inside area defined by the at least one outline;

producing at least one set of image data representing the original image;

producing outline sewing data for making stitches on the work sheet along the at least one outline; and producing area sewing data for making stitches on the work sheet to fill the inside area thereby forming the embroidery of the original image on the work sheet.

16. A method according to claim 15, wherein at least one of the step of producing said outline sewing data and the step of producing said area sewing data, comprises specifying a first sewing manner.

17. A method according to claim 16, wherein said at least one of the step of producing said outline sewing data and the step of producing said area sewing data, further comprises producing at least one of said outline sewing data and said area sewing data to form stitches in said first sewing manner.

18. A method according to claim 16, wherein said at least one of the step of producing said outline sewing data and the step of producing said area sewing data, further comprises:

specifying a second sewing manner different from said first sewing manner, and producing at least one of said outline sewing data and said area sewing data to form stitches in said second sewing manner.

19. A method according to claim 16, wherein said at least one of the step of producing said outline sewing data and the step of producing said area sewing data, further comprises selecting, as said first sewing manner, one of a plurality of sewing manners, based on a characteristic of said outline-bounded region.

20. A method according to claim 16, wherein said at least one of the step of producing said outline sewing data and the step of producing said area sewing data, further comprises selecting, as said first sewing manner, one of a plurality of sewing manners by operating an input device.

21. A method according to claim 15, further comprising the step of utilizing said outline sewing data and area sewing data to control the sewing machine to form, on the work sheet, said embroidery corresponding to said original image.

22. A method according to claim 21, wherein the step of utilizing said outline sewing data and area sewing data comprises controlling a stitch-forming device of the sewing machine to form stitches according to said outline sewing data and area sewing data to thereby produce said embroidery on the work sheet.

23. A method according to claim 21, wherein the step of utilizing said outline sewing data and area sewing data comprises recording, in an external memory, said outline sewing data and area sewing data to control the sewing machine to form said embroidery on the work sheet.

24. A method according to claim 15, wherein the step of reading said original image includes the steps of:

reading said original using an image reader, wherein the original is prepared by a user; and producing outline-defining data defining said outline, said image data including said outline-defining data.

* * * * *